US006430783B1

(12) United States Patent
Benoit

(10) Patent No.: US 6,430,783 B1
(45) **Date of Patent: *Aug. 13, 2002**

(54) MERCHANDISE PAIRING TIE

(75) Inventor: James C. Benoit, Needham, MA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/527,997

(22) Filed: Mar. 17, 2000

Related U.S. Application Data

(63) Continuation-in-part of application No. 09/111,937, filed on Jul. 8, 1998, now abandoned.

(51) Int. Cl.[7] ..... B65D 63/00
(52) U.S. Cl. ..... 24/16 PB
(58) Field of Search ..... 24/16 PB, 16 R, 24/17 AP, 30.5 R, 30.5 P, 17 A; 248/74.3

(56) References Cited

U.S. PATENT DOCUMENTS

| | | | | |
|---|---|---|---|---|
| 3,000,067 | A | * | 9/1961 | Hanflig |
| 3,482,335 | A | * | 12/1969 | Ornsteen |
| 3,556,575 | A | | 1/1971 | Farkas |
| 3,570,497 | A | | 3/1971 | Lemole |
| 3,712,655 | A | | 1/1973 | Fuehrer |
| 3,766,608 | A | | 10/1973 | Fay |
| 3,816,879 | A | | 6/1974 | Merser et al. |
| 3,983,603 | A | | 10/1976 | Joyce |
| 4,001,898 | A | | 1/1977 | Caveney |
| 4,003,106 | A | | 1/1977 | Schumacher et al. |
| 4,240,183 | A | | 12/1980 | Sumimoto et al. |
| 4,263,697 | A | | 4/1981 | Speedie |
| 4,347,648 | A | | 9/1982 | Dekkers |
| 4,624,060 | A | * | 11/1986 | Maxwell |
| 4,680,836 | A | | 7/1987 | Wisecup |
| 4,688,302 | A | | 8/1987 | Caveney et al. |
| 4,728,064 | A | | 3/1988 | Caveney |
| 4,754,529 | A | | 7/1988 | Paradis |
| 4,951,362 | A | | 8/1990 | Denemark et al. |
| 4,978,091 | A | | 12/1990 | Anderson et al. |
| 5,135,188 | A | | 8/1992 | Anderson et al. |
| 5,146,654 | A | * | 9/1992 | Caveney et al. |
| 5,154,376 | A | | 10/1992 | Baum et al. |
| 5,274,933 | A | * | 1/1994 | Cole et al. |
| 5,524,945 | A | | 6/1996 | Georgopoulos et al. |
| 5,636,412 | A | | 6/1997 | Lodi et al. |
| 5,685,048 | A | | 11/1997 | Benoit |
| 6,105,210 | A | * | 8/2000 | Benoit |

FOREIGN PATENT DOCUMENTS

| | | | |
|---|---|---|---|
| FR | 2720613 | * | 8/1995 |
| GB | 2058194 | | 8/1980 |

* cited by examiner

*Primary Examiner*—James R. Brittain
(74) *Attorney, Agent, or Firm*—Kriegsman & Kriegsman

(57) ABSTRACT

A tie for use in pairing together two objects. The tie comprises a head having an elongated channel extending therethrough, a locking tang within the head, and a strap having a length of approximately 63.3 cm. The strap comprises a first end integrally formed onto the head and a second end. A projection is formed on the strap between the first end and the second end. The portion of the strap from the projection to the first end is in the form of an elongated, flexible filament having a length of approximately 59.5 cm. The elongated filament is narrow in thickness, narrow in width and has a generally uniform, rectangularly-shaped cross-section. The portion of the strap from the projection to the second end is formed in a ladder structure having a plurality of rungs. The rungs of the strap are sequentially engaged by the locking tang when the strap is inserted into and through the elongated channel to form a closed loop. As the strap is further inserted through the elongated channel, the size of the closed loop is decreased. The projection serves as a stop to limit the minimum size of the closed loop which can be formed when the strap is inserted into the head.

16 Claims, 2 Drawing Sheets

MERCHANDISE PAIRING TIE

CROSS-REFERENCE TO RELATED APPLICATIONS

This application is a continuation-in-part of U.S. patent application Ser. No. 09/111,937, which was filed on Jul. 8, 1998 in the name of James C. Benoit abandoned.

BACKGROUND OF THE INVENTION

The present invention relates to a tie for pairing together two objects such as shoes or sneakers or gloves.

Ties are widely used for the bundling of objects such as a group of wires. One known tie comprises a serrated strap that is fitted to an apertured head containing an internal pawl or locking tang that engages the serrations of the strap. Another known tie is in the form of an apertured strap fitted to a buckle-like head, with a tongue that enters the apertures of the strap.

In U.S. Pat. No. 3,766,608 to Fay, which is incorporated herein by reference, there is disclosed a tie formed by a locking head and an attached ladder strap. The head contains a longitudinal guide channel for receiving the strap, after encirclement of items to be bundled, and an internal locking tang. The latter is deflected with respect to relatively narrow auxiliary channels on opposite sides of the guide channel. One of the auxiliary channels receives the locking tang during the bundling of the items; the other auxiliary channel contains a stop against which the locking tang becomes abutted in planar engagement by the reverse thrust of the harnessed items.

In U.S. Pat. No. 4,347,648 to Dekkers, which is incorporated herein by reference, there is disclosed a tie formed by a locking head and an attached ladder strap. The head contains a locking tang and a guide channel that receives the strap after encirclement of items to be bundled. The tang engages the rungs of the ladder strap for the adjustable retention of the items. The free end of the strap has a light-weight webbed tail that facilitates the insertion of the strap into the head. The strap is advantageously molded of a stretch reorientable material and is subsequently stretched to produce a suitable strengthening and elongation of the webbed tail.

Ties have been found to be very useful and effective in bundling objects together. In addition, some ties, particularly the tie described in U.S. Pat. No. 4,347,648 to Dekkers, have also been used to pair together articles of commerce, such as pairs of shoes. Used in this manner, the tie does not hold the pair of articles together in a bundle but rather serves to keep the two pieces of merchandise together. In this capacity, the tie has been found to be very a useful device, for example, in displaying a pair of shoes for sale.

To use a tie of the type described above to pair together a pair of shoes, the tail end of the strap is inserted through an eyelet or under the shoelace of each shoe. The tail is then inserted through the guide channel of the head so that the strap forms a closed loop. As the strap is further drawn forward through the guide channel of the head, the closed loop decreases in size.

It should be noted that if the strap is drawn too far forward through the guide channel of the head, the size of the closed loop of the tie will become too small to enable a prospective buyer to comfortably put on both shoes at the same time because the two shoes will be too close to each other.

Accordingly, in U.S. Pat. No. 5,685,048 to J. C. Benoit, which issued on Nov. 11, 1997 and which is incorporated herein by reference, there is disclosed a merchandise pairing tie for use in pairing together two objects. The tie comprises a head having an elongated channel extending therethrough, a locking tang within the head, and a strap extending from the head. The strap is approximately 30 cm in length and is formed in a ladder structure having a plurality of rungs. The rungs of the strap are sequentially engaged by the locking tang when the strap is inserted into and through the elongated channel to form a closed loop. As the strap is further inserted through the elongated channel, the size of the closed loop is decreased. The tie further includes a projection formed on a rung of the strap and located approximately 26 cm from the head. The projection protrudes upward from the rung approximately 1 mm and serves as a stop to limit the minimum size of the closed loop which can be formed when the strap is inserted into the head.

SUMMARY OF THE INVENTION

It is an object of the present invention to provide a new tie of the type having a locking head and an attached ladder strap.

It is another object of the present invention to provide a tie as described above which is particularly useful in pairing two objects.

It is still another object of the present invention to provide a tie as described above which is inexpensive to manufacture and easy to use.

Accordingly, there is provided a tie for pairing together two objects comprising a head having an elongated channel extending therethrough, a locking tang within said head, a strap having a first end and a second end, the first end being integrally formed onto said head, and a projection formed on said strap between the first end and the second end, the portion of said strap from said projection to the first end being in the shape of a filament, the portion of said strap from said projection to the second end being engagable by said locking tang when said strap is inserted into and through the elongated channel to form a closed loop, wherein increased insertion of said strap through the elongated channel decreases the size of the closed loop, said projection limiting the minimum size of the closed loop which can be formed.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate an embodiment of the invention and, together with the description, serve to explain the principles of the invention. In the drawings, wherein like reference numerals represent like parts.

DETAILED DESCRIPTION OF A PREFERRED EMBODIMENT

Figure 1:
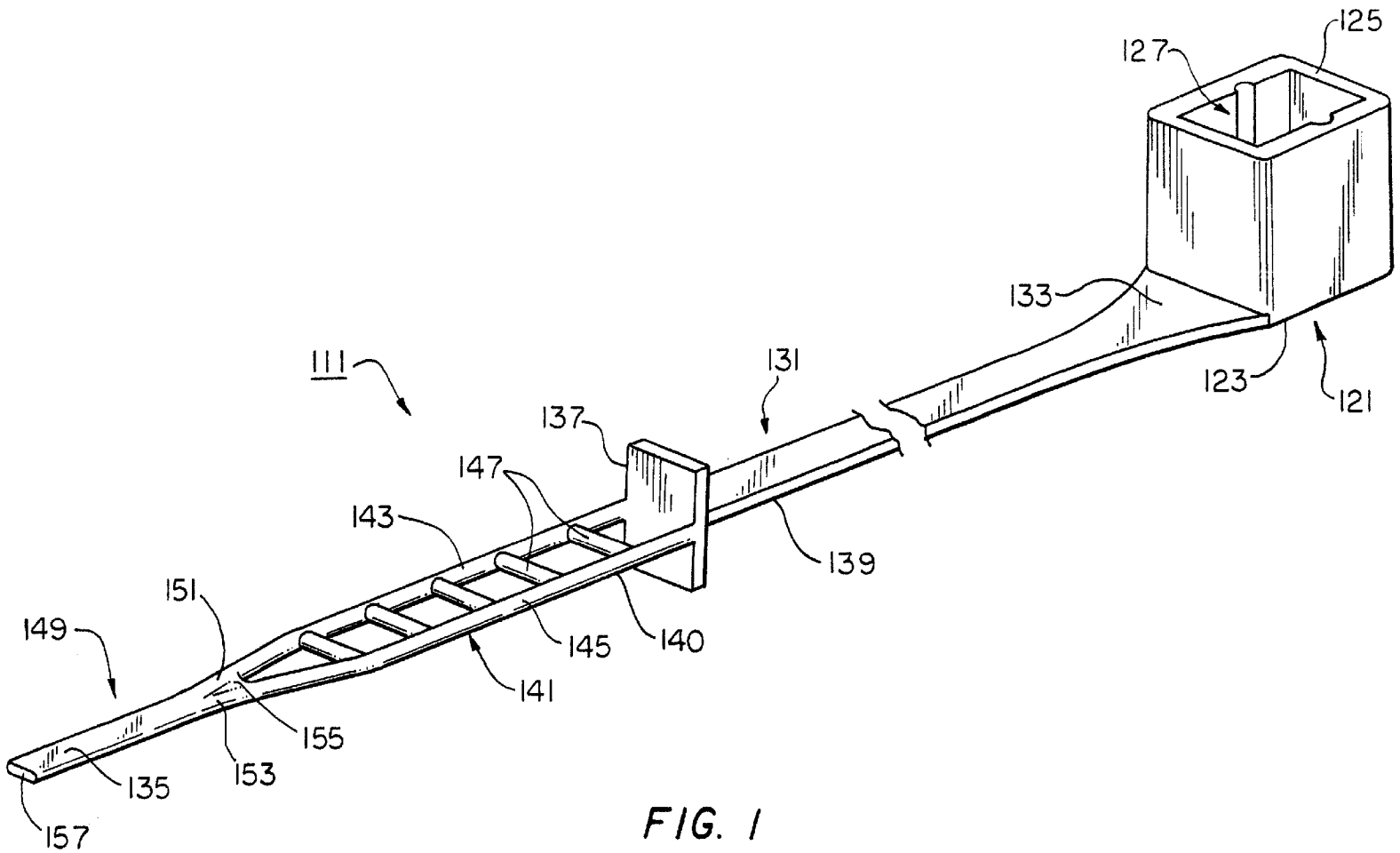
FIG. 1 is a perspective view, broken away in part, of a tie constructed according to the teachings of the present invention for pairing together two objects.
Figure 2:
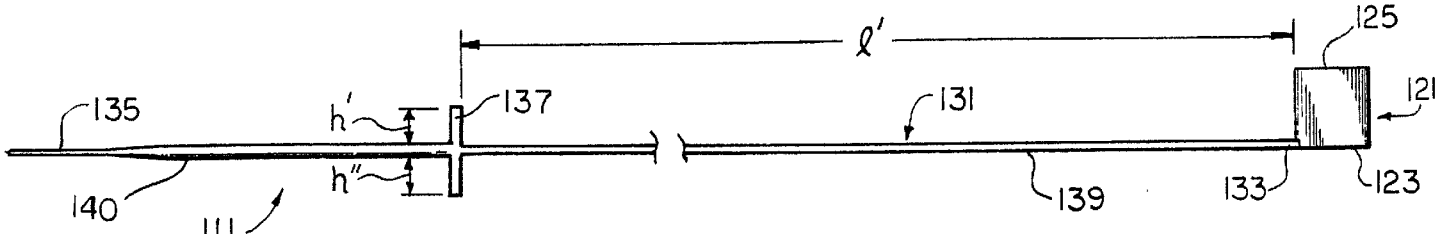
FIG. 2 is a right side view, broken away in part, of the tie shown in FIG. 1.
Figure 3:
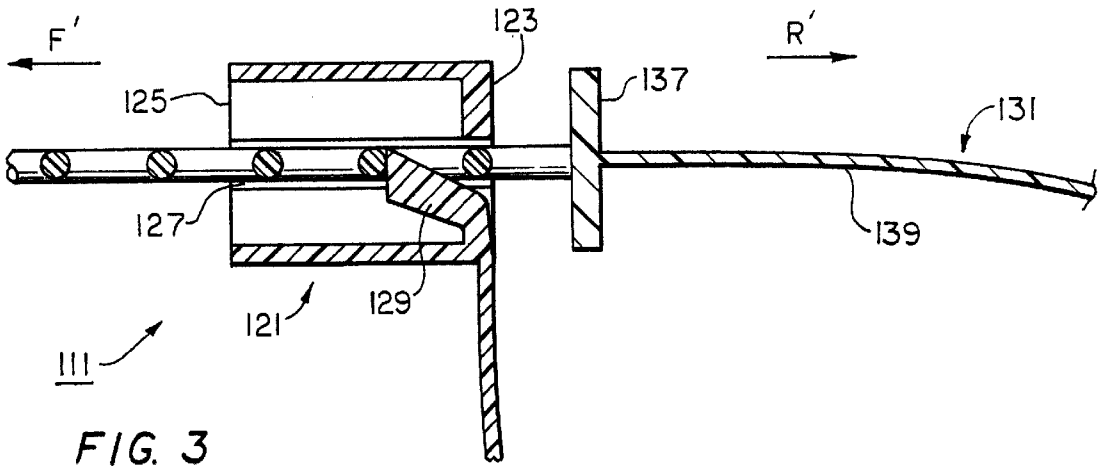
FIG. 3 is a perspective view, broken away in part, of the tie shown in FIG. 1, the strap being shown inserted through the head.

Referring now to FIGS. 1–3, there is shown a tie constructed according to the teachings of the present invention for pairing together two objects, the tie being represented generally by reference numeral 111. As will be discussed in detail below, tie 111 is longer in length, less expensive to manufacture and more flexible than the tie disclosed in U.S. Pat. No. 5,685,048 to J. C. Benoit.

Tie 111 includes a head 121 and an attached strap 131.

Head 121 is identical in construction with the head of the tie disclosed in U.S. Pat. No. 5,685,048 to J. C. Benoit. Specifically, head 121 is generally rectangular in shape and includes a bottom wall 123, a top wall 125, and an elongated channel 127 which extends through head 121 from bottom wall 123 to top wall 125. Head 121 further includes a locking tang 129 which may be either of the stationary type or the deflectable type.

Strap 131 comprises a first end 133, a second end 135 and an enlarged rectangular projection 137 which is formed on strap 131 at a location between first end 133 and second end 135. First end 133 is integrally formed onto head 121 to make tie 111 a unitary device. Projection 137 serves as a stop when tie 111 is used to pair together two objects, as will be described in detail below. Projection 137 also serves to divide strap 131 into two portions.

The portion of strap 131 from projection 137 to first end 133 is in the form of an elongated, flexible filament 139. Elongated, flexible filament 139 is narrower in thickness and width than the portion 140 of strap 131 from projection 137 to second end 135 and has a generally uniform, rectangularly-shaped cross-section.

It should be noted that elongated filament 139 is not limited to a generally rectangularly-shaped cross-section. Rather, elongated filament 139 could have an alternatively-shaped cross-section (i.e., circular or elliptical) without departing from the spirit of the present invention.

The portion 140 of strap 131 from projection 137 to second end 135 comprises a ladder structure 141. Ladder structure 141 comprises a pair of side rails 143 and 145 and a plurality of rungs 147. Ladder structure 141 terminates into a elongated webbed tail 149 which is formed at second end 135. Tail 149 is formed by extensions 151 and 153 of side rails 143 and 145, respectively. Webbing 155 occupies the interval between extension side rails 151 and 153. Tail 149 tapers into a narrow tip 157 approximately 3 mm in width.

As shown in FIG. 2, projection 137 protrudes upward above rungs 147 a distance "h'" of approximately 1 mm. Similarly, projection 137 protrudes downward beneath rungs 147 a distance "h"" of approximately 1 mm.

Strap 131 can be molded using conventional molding techniques. As can be appreciated, the simplicity of the size and shape of elongated filament 139 considerably simplifies the process for molding strap 131 when compared to the process for molding the strap of the tie disclosed in U.S. Pat. No. 5,685,048. As a consequence, tie 111 is considerably cheaper to mold than the tie disclosed in U. S. Pat. No. 5,685,048, which is desirable.

Upon completion of the molding process, filament 139 of tie 111 can be stretched using conventional stretching techniques so that projection 137 is a distance "1'" of approximately 59.5 cm from head 21 after the stretching process, strap 131 having a total length of approximately 63.3 cm. Strap 131 is preferably constructed of a molecular reorientable type material, such as nylon, polypropylene, polyester, urethane, or the like. This material, upon stretching, not only reduces the volume per unit length of the strap but also provides enhanced physical properties, such as an increase in tensile and shear strength.

It should be noted that the thin size and shape of elongated filament 139 makes strap 131 of tie 111 much more flexible than the strap of the tie disclosed in U.S. Pat. No. 5,685,048, which is desirable. Increased levels of flexibility in strap 131 of tie 111 simplifies the ease in which tie 111 can be formed into a closed loop during use.

It should also be noted that the particular size and shape of elongated filament 139 enables filament 139 to be stretched a considerable length. In particular, due to the construction of elongated filament 139, strap 131 of tie 111 can be stretched a length much longer length than the strap of the tie disclosed in U.S. Pat. No. 5,685,048 without the need for additional materials, which is desirable.

In use, tie 111 can be used to pair together two shoes, or other similar objects such as shoes or sneakers, in the following manner. First, tail 149 is threaded through an eyelet in each shoe. Tail 149 is then inserted into channel 127 of head 121 to form a closed loop. Tail 149 is advanced through bottom wall 123 of head 121 and out through top wall 125 in a forward direction, the forward direction being represented by arrow F' in FIG. 3. Drawing strap 131 forward through head 121 decreases the size of the closed loop. Locking tang 129 is designed so as to permit strap 131 to advance forward through head 121. Locking tang 129 is also designed to engage rungs 147 when strap 131 is thrust in the reverse direction, the reverse direction being shown by arrow R' in FIG. 3. Therefore, strap 131 can be advanced forward through head 121 to decrease the size of the closed loop, but strap 131 can not be thrust in the reverse direction to increase the size of the closed loop. As a result, once strap 131 is advanced through head 121 to secure the pair of shoes together, the shoes remain paired together until cable tie 111 is severed.

Strap 131 is capable of advancement through head 121 until projection 137 hits up against bottom wall 123 of head 121.

It should be noted that, because strap 131 of tie 111 is considerably longer than the strap of the tie disclosed in U.S. Pat. No. 5,685,048, tie 111 can be used to pair together two objects but, at the same time, can enable the two objects to be separated approximately 29.5 cm apart from one another. To the contrary, the tie disclosed in U.S. Pat. No. 5,685,048 can be used to pair together two objects but can only separate the two objects approximately 13 cm apart from one another.

The increase in the length of strap 131 of tie 111 compared to the length of the strap of the tie disclosed in U.S. Pat. No. 5,685,048 is significant in that tie 111 pairs together two objects, such as shoes, without prohibiting a prospective buyer from having the opportunity to put on the shoes and comfortably walk around in order to sample the comfort of the shoes, which is desirable. To the contrary, the tie disclosed in U.S. Pat. No. 5,685,048 does not allow a prospective buyer to walk in the shoes with the freedom that tie 111 permits. Rather, the tie disclosed in U.S. Pat. No. 5,685,048 allows a prospective buyer to put on both shoes comfortably, but does not comfortably enable the buyer to walk around in the shoes.

The embodiment of the present invention described above is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A tie for pairing together two objects comprising:

a) a head having an elongated channel extending therethrough, b) a locking tang within said head, c) a strap having a first end and a second end, the first end being integrally formed onto said head, and d) a projection formed on said strap between the first end and the second end, e) the portion of said strap from said projection to the first end being in the shape of a filament which is narrower in thickness and width than the portion of said strap from said projection to the second end, f) the portion of said strap from said projection to the second end being engagable by said locking tang when said strap is inserted into and through the elongated channel to form a closed loop, wherein increased insertion of said strap through the elongated channel decreases the size of the closed loop, said projection limiting the minimum size of the closed loop which can be formed to a size which permits the two objects to be spaced apart a distance greater than 13 cm.

2. The tie as claimed in claim 1 wherein said projection is a distance greater than 26 cm from the head.

3. The tie as claimed in claim 2 wherein said projection limits the minimum size of the closed loop which can be formed to a size which permits the two objects to be spaced approximately 29.5 cm apart.

4. The tie as claimed in claim 3 wherein said projection is approximately 59.5 cm from the head.

5. The tie as claimed in claim 4 wherein said strap is approximately 63.3 cm in length.

6. The tie as claimed in claim 5 wherein said projection is generally rectangular in cross-section.

7. The tie as claimed in claim 6 wherein said projection extends upward from the portion of said strap from said projection to the second end approximately 1 millimeter.

8. The tie as claimed in claim 7 wherein said projection extends downward from the portion of said strap from said projection to the second end approximately 1 millimeter.

9. The tie as claimed in claim 8 wherein said strap includes a webbed tail portion which tapers into a narrow tip approximately 3 millimeters wide, thereby facilitating the insertion of said strap through relatively small openings.

10. The tie as claimed in claim 9 wherein said strap is formed by molding.

11. The tie as claimed in claim 10 wherein the strap portion from said projection to said first end is stretched.

12. The tie as claimed in claim 11 wherein said strap is constructed of plastic.

13. The tie as claimed in claim 4 wherein said filament is substantially uniform in cross-section.

14. The tie as claimed in claim 13 wherein the portion of said strap from said projection to said second end comprises a ladder structure having rungs which are sequentially engaged by said locking tang when said strap is inserted into and through the elongated channel.

15. A method of pairing together two objects such as shoes, comprising the steps of:

a) providing a tie comprising a head having an elongated channel extending therethrough, a locking tang within said head, a strap having a first end and a second end, the first end being integrally formed onto said head, a projection formed on said strap between the first end and the second end, the portion of said strap from said projection to the first end being in the shape of a filament which is narrower in thickness and width than the portion of said strap from said projection to the second end, the portion of said strap from said projection to the second end being engagable by said locking tang when said strap is inserted into and through the elongated channel to form a closed loop, wherein increased insertion of said strap through the elongated channel decreases the size of the closed loop, said projection limiting the minimum size of the closed loop which can be formed, b) inserting said strap through an opening in each object, c) inserting the portion of said strap from said projection to the second end into the channel of said head to form a closed loop, and d) pulling the portion of said strap from said projection to the second end through said head until said projection hits upon said head thereby limiting the minimum size of the closed loop to a size which permits the two objects to be spaced apart a distance greater than 13 cm.

16. A tie for pairing together two objects comprising:

a) a head having an elongated channel extending therethrough, b) a locking tang within said head, c) a strap having a first end and a second end, the first end being integrally formed onto said head, and d) a projection formed on said strap between the first end and the second end, e) the portion of said strap from said projection to the first end being in the shape of a filament which is narrower in thickness and width than the portion of said strap from said projection to the second end, f) the portion of said strap from said projection to the second end being engagable by said locking tang when said strap is inserted into and through the elongated channel to form a closed loop, wherein increased insertion of said strap through the elongated channel decreases the size of the closed loop, said projection limiting the minimum size of the closed loop which can be formed.

* * * * *